United States Patent [19]

Smester et al.

[11] 4,420,802

[45] Dec. 13, 1983

[54] LIGHTING FIXTURE WITH THERMAL PROTECTOR BRACKET

[75] Inventors: Paul R. Smester, Mount Sinai; Edison A. Price, New York, both of N.Y.

[73] Assignee: Edison Price, Incorporated, New York, N.Y.

[21] Appl. No.: 484,890

[22] Filed: Apr. 14, 1983

[51] Int. Cl.[3] ..... F21S 1/06

[52] U.S. Cl. ..... 362/364; 362/145; 362/148; 362/376; 362/389; 362/404

[58] Field of Search ..... 362/364, 148, 145, 389, 362/404, 376

[56] References Cited

U.S. PATENT DOCUMENTS

| | | | |
|---|---|---|---|
| 2,717,955 | 9/1955 | Schwemmer et al. | 362/148 |
| 3,286,090 | 11/1966 | Brown | 362/364 |
| 3,302,019 | 1/1967 | Menzin | 362/364 |
| 3,683,173 | 8/1972 | Guth, Jr. | 362/364 |
| 3,801,815 | 4/1974 | Docimo | 362/364 |
| 4,199,803 | 4/1980 | Hunt | 362/145 |
| 4,358,635 | 11/1982 | Druffel | 362/365 |
| 4,379,321 | 4/1983 | Plemmons et al. | 362/145 |

*Primary Examiner*—Stephen J. Lechert, Jr.
*Assistant Examiner*—Howard J. Locker
*Attorney, Agent, or Firm*—McAulay, Fields, Fisher, Goldstein & Nissen

[57] ABSTRACT

A recessed incandescent lighting fixture has a faceplate and a wireway spaced from the faceplate for holding a bulb socket and for effecting the electrical connections to the fixture. A substantially cylindrical thermal protector is connected to the wireway by a wireway extension comprising a flexible metallic conduit; and a bracket is disposed on the rear surface of the faceplate for releasably retaining the protector and conduit thereat. The bracket comprises a base member, a first mounting member having a first slot therein for releasably retaining the thermal protector, a second mounting member having two arms forming a second slot for releasably receiving the minor root diameter of the conduit, and a spacing member disposed in the slots for deflecting the two arms relative to each other at an angle substantially equal to the pitch of the conduit thread.

9 Claims, 6 Drawing Figures

LIGHTING FIXTURE WITH THERMAL PROTECTOR BRACKET

BACKGROUND OF THE INVENTION

The present invention relates to recessed incandescent lighting fixtures and in particular to hardware for use with temperature protector therefor.

Recently, building codes have been amended to require thermal protective devices or thermal protector with incandescent recessed lighting fixtures, because these lighting fixtures may become covered with insulating material which then ignite from overheating of the fixture.

A widely used thermal protector which complies with the aforementioned building codes, has its own heater therein combined with a thermally activated circuit breaker designed to open if a predetermined safe operating temperature is exceeded. If the thermal protector gets covered with insulation that will cause an increase in the protector temperature which is sufficient to trip the safety circuit therein and turn off the lamp.

The way in which this problem has been avoided, is to mount the protector on the top surface of the ceiling mounting plate of the incandescent fixture. This has necessitated the mounting of a junction box on the faceplate to support the protector and to terminate the flexible metallic conduit covering the wiring connection of the detector.

SUMMARY OF THE INVENTION

The main object of the present invention is to provide an improved bracket for recessed incandescent lighting fixtures and, at the same time, provide a simpler and more economical method of mounting a thermal protector thereon and to prevent the easy or accidental separation therebetween.

These and other objects of the present invention are achieved in a recessed incandescent lighting fixture having a faceplate and a wireway above the ceiling mounting plate which holds a lamp socket and which covers the electrical connections to the fixture. In accordance with the invention, the thermal protector is electrically connected to the wireway by wire enclosed in a flexible metallic conduit. A bracket is provided which is mounted on the top surface of the ceiling mounting plate and which enables the flexible metallic conduit and the thermal protector to be snapped into place and thereby be releasably retained above the top surface of the ceiling mounting plate.

By the provision of the bracket in accordance with the present invention, no additional hardware or tools are necessary to mount the detector in place. Moreover, the use of the conduit as a wireway extension eliminates the need for a junction box disposed over the top surface of the ceiling mounting plate. In this way, a great deal of hardware is eliminated in each fixture making the fixture more economical to construct and simpler to use.

The bracket in accordance with the present invention is particularly useful in that it reliably holds the thermal protector and flexible conduit in proper juxtaposition so that the electrical conductors remain fully covered by the flexible metallic conduit, and in that it is easy to manufacture and requires no tools for mounting the conduit and protector.

In accordance with the invention, the bracket comprises a base member, a first mounting member extending upwardly from the base member and a second mounting member extending upwardly from the base member and spaced apart from the first mounting member. The first mounting member has a first slot therein for releasably retaining the thermal protector, which is preferably a Leviton Thermal Insulation Detector Model #9454, the specifications for which are hereby incorporated by reference. The second member has a second slot formed by two bendable arms which releasably receive the external root thread diameter of a flexible metallic conduit which is a standard conduit used in the electrical industry with an outside diameter of approximately 0.6"and an external root diameter of approximately 0.475". For example, the conduit can be Electri-Flex Company, Catalog #USL-716 conduit with a 7/16" inside diameter.

The bracket further comprises a spacing member having end portions disposed in the slots below the protector and conduit and having means disposed at one end portion received in the second slot for deflecting the two arms relative to each other at an angle substantially equal to the pitch of the flexible metallic conduit.

The base and mounting member preferably comprise sheet metal with the base and mounting members preferably formed from the same integral piece of metal and with the mounting members extending perpendicular to the base. The spacing member is also preferably formed from sheet metal. The sheet metal is preferably 20 guage steel, and the mounting members are preferably a high tensity sponge temper steel, however, it can be made from other common forms of metal material.

These and other objects and advantages of the present invention will be explained in more detail from the following description of the invention taken in conjunction with the drawings, wherein:

DETAILED DESCRIPTION OF THE INVENTION

Figure 1:
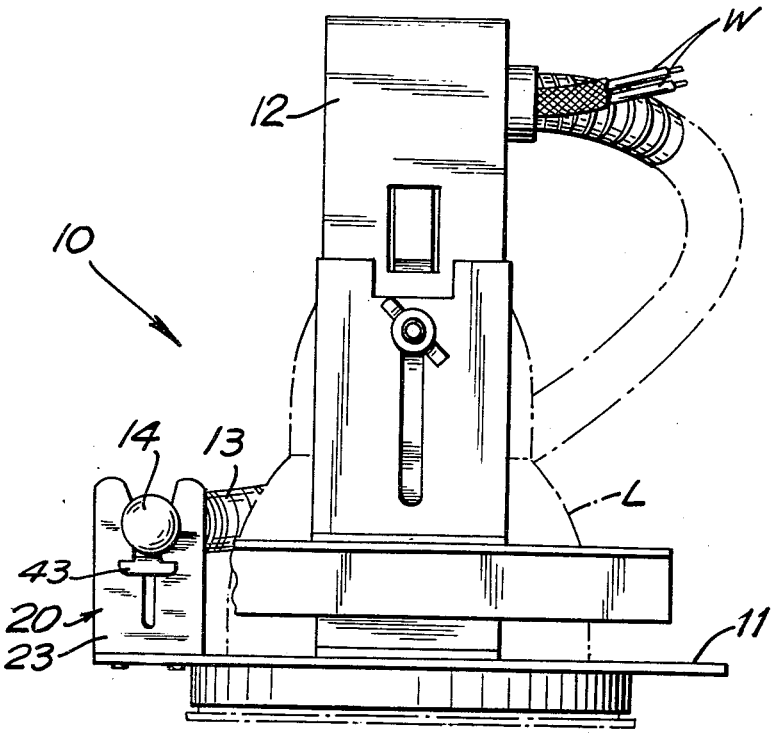
FIG. 1 is an elevational view of the fixture according to the invention.
Figure 2:
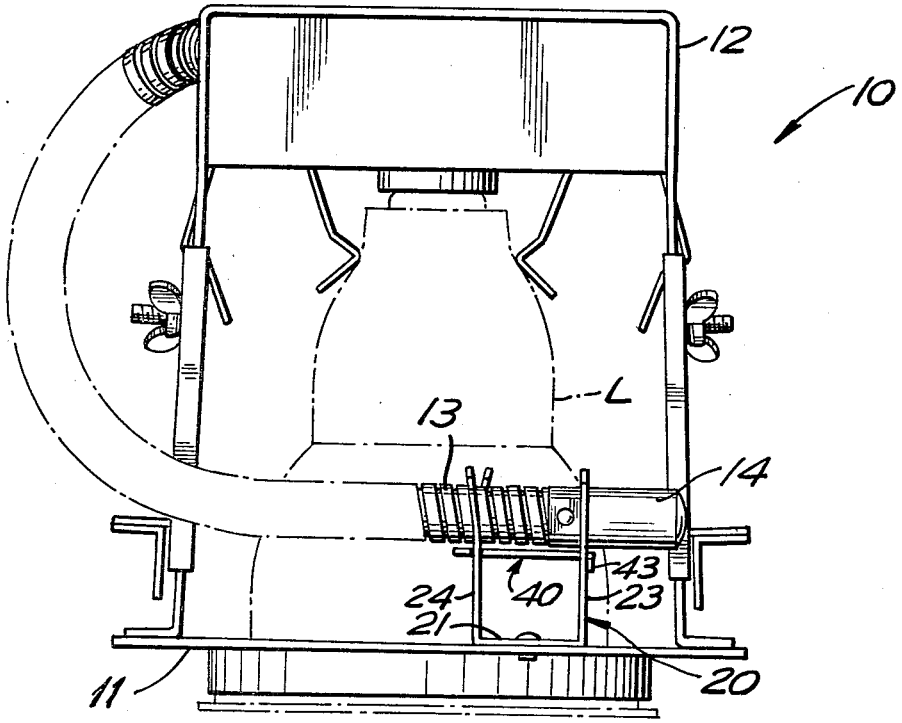
FIG. 2 is an elevational view of another side of the fixture shown in FIG. 1.

FIGS. 1 and 2 show an incandescent recessed lighting fixture 10 according to the present invention including a ceiling mounting plate 11 and the attendant hardware attached to the top face thereof including wireway 12 which holds a socket for lamp L and which effects the electrical connection to the fixture via the electrical wires W that are connected thereto.

Wireway 12 also includes a wireway extension 13 comprising a flexible metallic conduit which has an outside root diameter of 0.475" and an outside diameter of 0.6" and a pitch of approximately 15°.

Attached to the end of the conduit 13 is a substantially cylindrical thermal protector 14 which is a Leviton Thermal Indulation Detector, Model #9454 and which is selected for the particular size of lamp L being used in the fixture.

The fixture 10 is set into place in a conventional manner in a ceiling and if it is desired to use the thermal protector 14, the protector and conduit 13 are snapped into place in bracket 20 provided on the top face of the ceiling mounting plate 11.

As can be seen from FIGS. 1 and 2, the need for a separate junction box for the protector 14 is eliminated and the protector 14 and conduit 13 are securely and positively mounted so that they cannot easily be removed except by applying a substantial prying force with a lever tool.

FIGS. 3–6 show in a more detailed manner the bracket 20 and the way in which it coacts with protector 14 and conduit 13.

Figure 3:
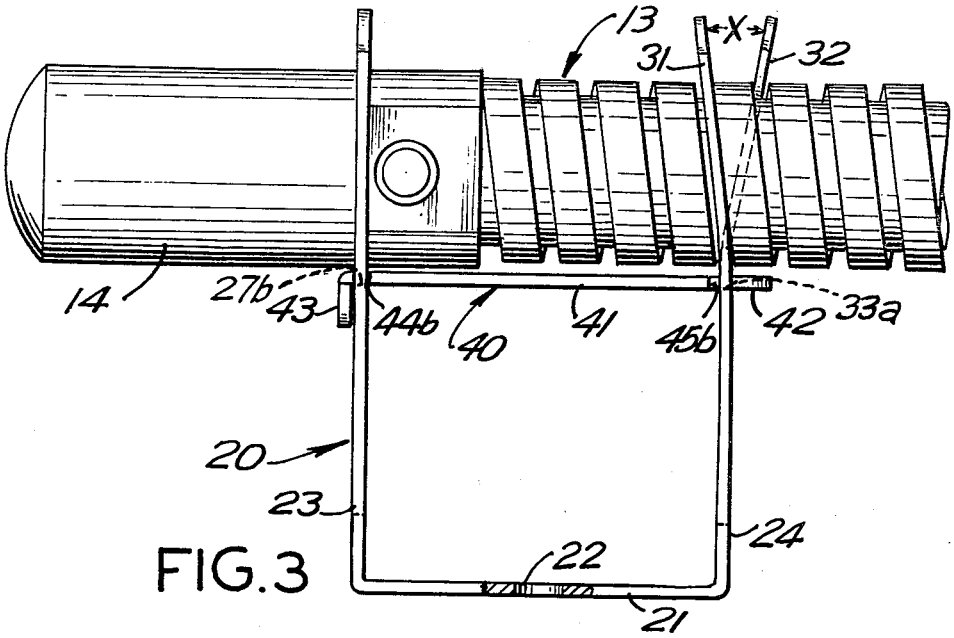
FIG. 3 is a side view of the bracket shown in FIG. 1.

The bracket 20 is shown in FIG. 3 in its most advantageous commercial embodiment, that is, comprising 20 guage sheet spring steel with the base 21 thereof being approximately $1\frac{5}{8}''$ long and $1\frac{1}{8}''$ wide and the mounting members 23 and 24 being approximately $1\frac{7}{8}''$ high.

The base 21 includes a mounting holes 22 which receive rivets extending through plate 11 to permanently fix the bracket 20 to plate 11.

Extending upwardly from the base 21 are the mounting members 23, 24 which are preferably formed from the same piece of sheet metal and are bent at 90° with respect to the base 21.

Figure 4:
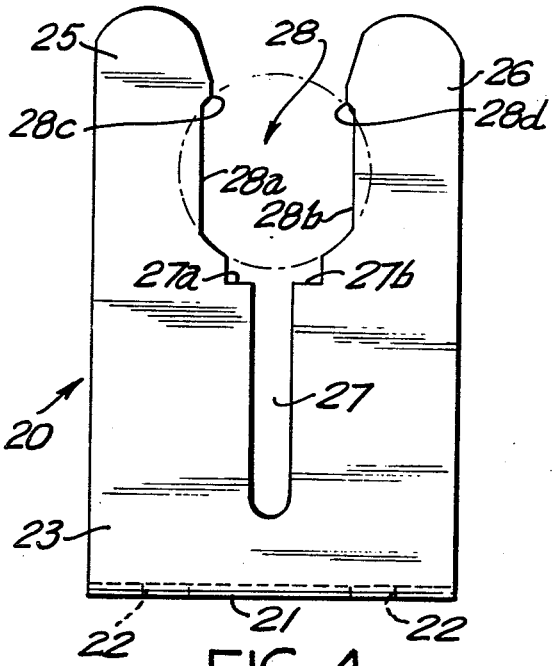
FIG. 4 shows one end of the bracket of FIG. 3.

Mounting member 23 is shown in more detail in FIG. 4 and comprises two arms 25, 26 which are separated by slots 27 and 28 which is configured to releasably retain the protector 14 at a detented portion thereof as shown in FIGS. 3 and 4. The slot 27 enables the arms 25, 26 to be able to resiliently deform (i.e., move relative to each other) to accept the protector 14 so as to be able to snap it very easily in place in slot 28 and yet make it difficult to remove without using an appropriate tool.

That is, the slot 28 is configured to slope downwardly and inwardly and to have a detent portion formed by shoulders **28*c*, 28*d* followed by straight edge portions 28*a*. The sloping edges at the entrance of slot 28 combined with the resilient deformation of the arms 25, 26 permit the easy insertion of the protector 14 into the slot. However, when the protector passes the shoulders 28*c*, 28*d*, the arms snap back into place and the shoulders bear on the protector 14** to prevent its accidental or intentional removal without the aid of some tool.

Following the slot 28 is a flattened or seat portion **27*a*, 27*b* upon which a portion of a spacing member 40** rests during use, as will be explained hereinafter.

Figure 5:
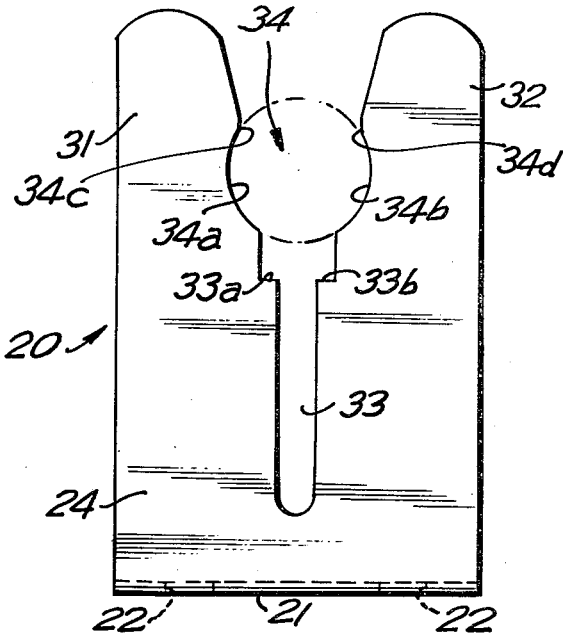
FIG. 5 shows the other end of the bracket of FIG. 3.

The other mounting member 24, as can be seen from FIGS. 3 and 5, comprises two arms 31, 32 separated by slots 33, 34 as shown. The slot 34 is configured to receive the outside minor root diameter of conduit 13, while the slot 33 is provided to impart the flexibility to the arms 31, 32. As in mounting member 23, seats **33*a*, 33*b* are provided for receiving the spacing member 40**.

The slot 34 has shoulder detents **34*c*, 34*d* and arcuate portions 34*a*, 34*b* for receiving the outside root diameter of the conduit 13. Detents 34*a*, 34*b* operate in the same manner as detents 28*c*, 28*d*** to retain the flexible metallic conduit in place.

Figure 6:
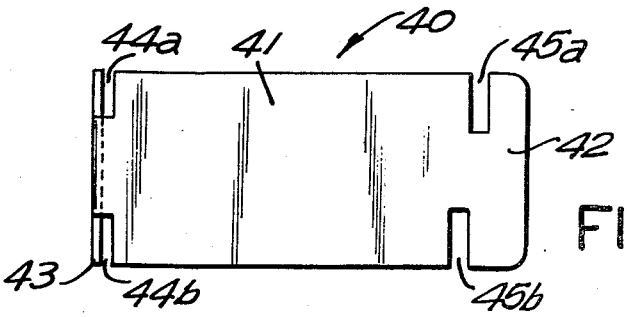
FIG. 6 is a top view of the spacing member of the bracket shown in FIG. 3.

The spacing member 40, as shown in FIG. 3 and FIG. 6, comprises a body portion 41 which has one end portion comprising two slots **44*a*, 44*b* which are aligned and which are followed by a bent down portion 43. Portion 43 sits on the outside of mounting member 23 with the arms 25, 26 received in slots 44*a*, 44*b* respectively. The portion between slots 44*a*, 44*b* rests on seats 27*a*, 27*b*. The portion 43 is provided to insure proper orientation of the members. That is, as noted below, the member 40 is always located on bracket 20 with portion 40** extending downwardly.

The other end of the body 41 comprises two longitudinally offset slots **451, 45*b*. These slots are offset by approximately 1/16" and are configured to receive respective arms 32 and 31. Upon forcing the spacing member 40 into the position shown in FIG. 3, the offset of slots 45*a* and 45*b* causes arms 31, 32 to deform relative to one another from the co-planar state shown in FIG. 5 to the position shown in FIG. 3 wherein the two arms are at an acute angle X with respect to each other. Angle X is preferably the pitch angle of the thread of conduit 13. In this way, conduit 13 easily snaps into place in slot 34 without the need for the user to have to bend arms 31, 32 by hand. It will now be apparent that if spacing member 43 is installed upside-down, the angle X would assume a reverse pitch. Thus, the downward lip 43** always ensures proper installation.

It will be appreciated that the instant specification and claims are set forth by way of illustration and not limitation, and that various modifications and changes may be made without departing from the spirit and scope of the present invention.

What is claimed is:

1. In a recessed incandescent lighting fixture having a faceplate and a wireway spaced from said faceplate for holding a bulb socket and for effecting the electrical connections to the fixture, the improvement comprising: a substantially cylindrical thermal protector connected to said wireway by a wireway extension comprising a flexible metallic conduit; and a bracket for releasably retaining the protector and cable on the rear surface of the faceplate, the bracket comprising a base member mounted on the rear surface of the faceplate, a first mounting member extending outwardly from the base member and having means forming a first slot therein for releasably retaining the thermal protector, a second mounting member extending outwardly from the base member and spaced apart from the first mounting member, the second mounting member having means including two bendable arms forming a second slot for releasably receiving the minor root diameter of the conduit, and a spacing member having end portions disposed in the slots between the base member and the protector and conduit and having deflecting means disposed at the one end portion received in the second slot for deflecting the two arms relative to each other at an angle substantially equal to the pitch of the conduit thread.

2. The fixture according to claim 1, wherein the base and mounting members comprise planar metal material and the mounting members extend perpendicularly from the base member and are parallel to each other.

3. The fixture according to claim 2, wherein the base and mounting members are formed from one integral sheet of metal.

4. The fixture according to claim 1, wherein the first slot comprises a first portion receptive of the protector a reduced width second portion thereabove to retain said protector in place, a seat below the first portion upon which the spacing member rests, and a narrow slit extending below the seat towards the base member.

5. The fixture according to claim 4, wherein the protector has parallel surfaces at the connected end thereof, and wherein the first portion of the first slot is formed by parallel straight edges on the arms.

6. The fixture according to claim 1, wherein the second slot comprises a circular first portion having a reduced width at the top thereof to retain the conduit in place, a seat below the first portion on which the spacing member rests, and a narrow slit extending below the seat and towards the base member.

7. The fixture according to claim 1, wherein the spacing member has a planar portion, and said deflecting means comprises two slots in opposite sides of the planar portion disposed perpendicular to the direction between the first and second members and offset relative to each in said direction.

8. The fixture according to claim 7, wherein the spacing member further comprises a portion bent toward the base at the end portion received in the first slot to facilitate proper placement of said spacing member.

9. The fixture according to claim 1, wherein the base member has mounting holes therein for mounting the bracket on a faceplate.

* * * * *